US009183712B2

(12) United States Patent
Witmer et al.

(10) Patent No.: US 9,183,712 B2
(45) Date of Patent: Nov. 10, 2015

(54) SECURITY SYSTEM AND ALARM ACTIVATION CONTROL

(71) Applicant: Time Warner Cable Enterprises LLC, New York, NY (US)

(72) Inventors: Melinda C. Witmer, Scarsdale, NY (US); Peter Stern, Greenwich, CT (US); Adam Mayer, New York, NY (US); Christopher Williams, Chantilly, VA (US)

(73) Assignee: Time Warner Cable Enterprises LLC, New York, NY (US)

( * ) Notice: Subject to any disclaimer, the term of this patent is extended or adjusted under 35 U.S.C. 154(b) by 57 days.

(21) Appl. No.: 14/050,467

(22) Filed: Oct. 10, 2013

(65) Prior Publication Data

US 2015/0102922 A1 Apr. 16, 2015

(51) Int. Cl.
*G08B 23/00* (2006.01)
*G08B 13/00* (2006.01)

(52) U.S. Cl.
CPC ..... *G08B 13/00* (2013.01)

(58) Field of Classification Search
CPC .. G08B 29/185; G08B 13/00; G08B 13/1436; G08B 21/22
USPC ..... 340/527, 572.1, 505, 541, 501, 13.26
See application file for complete search history.

(56) References Cited

U.S. PATENT DOCUMENTS

| | | | | |
|---|---|---|---|---|
| 6,057,764 | A * | 5/2000 | Williams | 340/572.1 |
| 6,297,739 | B1 * | 10/2001 | Small | 340/573.3 |
| 7,005,990 | B1 * | 2/2006 | Rocci | 340/573.1 |
| 7,123,126 | B2 * | 10/2006 | Tanaka et al. | 340/5.2 |

* cited by examiner

*Primary Examiner* — Phung Nguyen
(74) *Attorney, Agent, or Firm* — Chapin IP Law, LLC

(57) ABSTRACT

A controller arms an alarm aspect of a corresponding security system. The corresponding security system is initially configured to audibly activate an alarm in response to detecting motion of free-to-roam entities in a monitored location. The free-to-roam entities can be provided unrestricted access into the monitored location. In addition to monitoring for presence of motion at the monitored location, the security system monitors the location for presence of a disarming device. At times of detecting presence of the disarming device at the monitored location, the security system prevents activation of the alarm based on detecting the motion of the free-to-roam entities.

34 Claims, 10 Drawing Sheets

SECURITY SYSTEM AND ALARM ACTIVATION CONTROL

BACKGROUND

Conventional security systems typically include multiple motion detectors that are distributed throughout a home environment to be monitored for intrusions. For example, a home environment can be partitioned to include multiple zones. A corresponding motion detector in each zone (such as a room in a house, portion of a yard, etc.) monitors occurrences of motion.

Each of the zones of motion detectors is typically connected to a central controller of the security system that makes decisions about activating a respective alarm. Assuming that a security system is armed, in response to detecting motion in one of the multiple monitored zones, the security system activates the alarm to indicate presence of a moving object. Accordingly, the security system can detect and provide notification of detecting motion, which is presumably an intruder.

Conventional security systems are prone to false alarms. For example, a homeowner's dog may walk past a respective motion detector in a zone when the security system is armed. The respective motion detector may sense motion of the dog. In response to sensing the motion of the dog, the respective motion detector notifies the central controller that motion was detected. In response to the notification of the motion, the central controller activates the alarm. Thus, a non-intrusive event such as the motion of the dog can cause a false alarm.

Occurrence of false alarms is typically very undesirable. Many times, a security system is linked to communicate occurrences of detected motion events to a corresponding security agency at a remote location. Upon receiving notification of a motion event while the security system is armed, the security agency notifies authorities such as the police to investigate the detected motion, which is possibly an unlawful intrusion. As discussed above, a detected motion event may be harmless and caused by motion of a dog or other animal as opposed to motion caused by a burglar. When the homeowner's dog accidentally trips a motion detector, it is not desirable to dispatch police to investigate the event.

To address this issue, motion detector devices and/or a corresponding central controller sometimes include a filter circuit. During operation, the filter circuit analyzes a corresponding received motion signal to determine a size of a detected moving object. If an estimated size of the corresponding moving object is detected as being below a threshold value, the core controller may prevent activation of the alarm. Thus, to some extent false alarms can be prevented.

BRIEF DESCRIPTION OF EMBODIMENTS

Conventional security systems suffer from a number of deficiencies. For example, because motion detection is complex, false alarms still occur due to motion of pets in a monitored location even though a respective motion signal is filtered for smaller moving objects such as pets.

Additionally, in certain situations, false alarms are caused not by pets but instead by a larger moving object such as a human being that is legitimately present in a respective home. As an example, a homeowner may arm the security system before going to bed at night. The homeowner may need to walk about the monitored premises after setting the alarm. To avoid a false alarm due to legitimate motion by the homeowner in her own home, the homeowner has to temporarily disarm the security system. Typically, to disarm the security system, the homeowner presses a sequence of buttons on a keypad to input a secret code or password. The keypad is typically affixed to a location such as a wall. After inputting a correct secret code, the homeowner is free to move about the house without worrying about activating the alarm. Upon returning to bed, the homeowner presses a sequence of buttons on the keypad again to arm the security system. Accordingly, substantial effort is required on the part of the homeowner to prevent occurrence of false alarms.

Embodiments herein deviate with respect to conventional techniques. For example, one embodiment herein is directed to reducing a number of false alarms caused by legitimate motion present in monitored premises. Embodiments herein can include temporarily preventing activation of an alarm of a security system to allow an authorized entity to move about a monitored location without tripping a corresponding alarm.

More specifically, in one embodiment, a controller receives input and arms an alarm of a corresponding security system. The corresponding security system is initially configured to audibly activate an alarm in response to detecting motion of free-to-roam entities in a monitored location. In one embodiment, the free-to-roam entities have unrestricted access into the monitored location. For example, there may be no physical barriers such as locked doors preventing the entities from entering or exiting the monitored location.

The security system monitors the location for presence of a disarming device as well as monitors the location for motion. At times of detecting presence of the disarming device at the monitored location, the security system prevents activation of the alarm even when detecting motion of the free roaming entities.

In accordance with one non-limiting example embodiment, the security system continuously (i.e., repeatedly, occasionally, etc.) monitors the location for the presence of a disarming device. As mentioned, even though motion is detected as being present at the monitored location, the security system prevents activation of the alarm at the times in which the disarming device is detected as being present at the monitored location. At other times, the security system initiates audible activation of a respective alarm when the disarming device is detected as being absent from at the monitored location and motion happens to be detected at the location. Audible activation of a respective alarm can include sounding a local alarm, transmitting an alert communication over a network to a remotely located target, etc.

Thus, embodiments herein can include receiving input (from a homeowner or other entity) to operate a security system in a first mode in which the security system conditionally activates an alarm to indicate occurrence of motion in a monitored domain. The security system can be configured to monitor the domain for motion as well as for presence of a disarming device. In response to detecting presence of the disarming device in the monitored domain, the security system switches to operating in a second mode in which the security system prevents activation of the alarm at times of detecting motion in the domain. That is, presence of the disarming device blocks activation of a respective alarm even during conditions such as when motion is detected. Subsequent to detecting presence of the disarming device, in response to detecting absence of the disarming device from the monitored domain, the security system switches back to operating the in the first mode again in which the security system conditionally activates the alarm to indicate detection of motion in the monitored domain.

Accordingly, presence and detection of a mobile disarming device provides a way to at least temporarily prevent activation of an alarm of a corresponding security system. For example, the disarming device can be possessed by an entity such as a homeowner, pet, etc., in the monitored region to prevent unwanted activation of a respective alarm, even though an alarm may have been initially activated. When the entity possessing the disarming device exits the monitored region, the corresponding security system reverts back to the previous setting of conditionally activating the respective alarm upon detecting motion.

These and other more specific embodiments are disclosed in more detail below.

Note that any of the resources as discussed herein can include one or more computerized devices, servers, base stations, wireless communication equipment, communication management systems, workstations, handheld or laptop computers, or the like to carry out and/or support any or all of the method operations disclosed herein. In other words, one or more computerized devices or processors can be programmed and/or configured to operate as explained herein to carry out different embodiments of the invention.

Yet other embodiments herein include software programs to perform the steps and operations summarized above and disclosed in detail below. One such embodiment comprises a computer program product including a non-transitory computer-readable storage medium (i.e., any physical computer readable hardware storage medium) on which software instructions are encoded for subsequent execution. The instructions, when executed in a computerized device (e.g., computer processing hardware) having a processor, program and/or cause the processor to perform the operations disclosed herein. Such arrangements are typically provided as software, code, instructions, and/or other data (e.g., data structures) arranged or encoded on a non-transitory computer readable storage medium such as an optical medium (e.g., CD-ROM), floppy disk, hard disk, memory stick, etc., or other a medium such as firmware or shortcode in one or more ROM, RAM, PROM, etc., or as an Application Specific Integrated Circuit (ASIC), etc. The software or firmware or other such configurations can be installed onto a computerized device to cause the computerized device to perform the techniques explained herein.

Accordingly, embodiments herein are directed to a method, system, computer program product, etc., that supports operations as discussed herein.

One or more embodiments herein include a computer readable storage medium and/or system having instructions stored thereon. The instructions, when executed by computer processor hardware, cause the computer processor hardware (such as in a security system) to: arm an alarm of a corresponding security system, the corresponding security system initially configured to audibly activate an alarm in response to detecting motion of free-to-roam entities in a monitored location; monitor the location for a disarming device; and at times of detecting presence of the disarming device at the monitored location, prevent activation of the alarm based on detecting the motion of the free-to-roam entities.

One or more embodiments herein include a computer readable storage medium and/or system having instructions stored thereon. The instructions, when executed by computer processor hardware, cause the computer processor hardware (such as in a security system) to: provide unrestricted access into a monitored domain; operate a security system to conditionally activate an alarm depending on detection of an intrusion into the monitored domain; monitor the domain for a disarming device; and while the disarming device is detected as being present in the monitored domain, prevent activation of the alarm.

One or more embodiments herein include a computer readable storage medium and/or system having instructions stored thereon. The instructions, when executed by computer processor hardware, cause the computer processor hardware (such as in a security system) to: receive input to operate a security system in a first mode in which the security system conditionally activates an alarm to indicate occurrence of motion in a monitored domain; monitor the domain for presence of a disarming device; in response to detecting presence of the disarming device in the monitored domain, operate the security system in a second mode in which the security system prevents activation of the alarm at times of detecting motion in the domain; and subsequent to detecting presence of the disarming device, in response to detecting absence of the disarming device from the monitored domain, operate the security system in the first mode again.

The ordering of the steps above has been added for clarity sake. Note that any of the processing steps as discussed herein can be performed in any suitable order.

Other embodiments of the present disclosure include software programs and/or respective hardware to perform any of the method embodiment steps and operations summarized above and disclosed in detail below.

It is to be understood that the system, method, apparatus, instructions on computer readable storage media, etc., as discussed herein also can be embodied strictly as a software program, firmware, as a hybrid of software, hardware and/or firmware, or as hardware alone such as within a processor, or within an operating system or a within a software application.

As discussed herein, techniques herein are well suited for controlling a security system. However, it should be noted that embodiments herein are not limited to use in such applications and that the techniques discussed herein are well suited for other applications as well.

Additionally, note that although each of the different features, techniques, configurations, etc., herein may be discussed in different places of this disclosure, it is intended, where suitable, that each of the concepts can optionally be executed independently of each other or in combination with each other. Accordingly, the one or more present inventions as described herein can be embodied and viewed in many different ways.

Also, note that this preliminary discussion of embodiments herein purposefully does not specify every embodiment and/or incrementally novel aspect of the present disclosure or claimed invention(s). Instead, this brief description only presents general embodiments and corresponding points of novelty over conventional techniques. For additional details and/or possible perspectives (permutations) of the invention(s), the reader is directed to the Detailed Description section and corresponding figures of the present disclosure as further discussed below.

Figure 1:
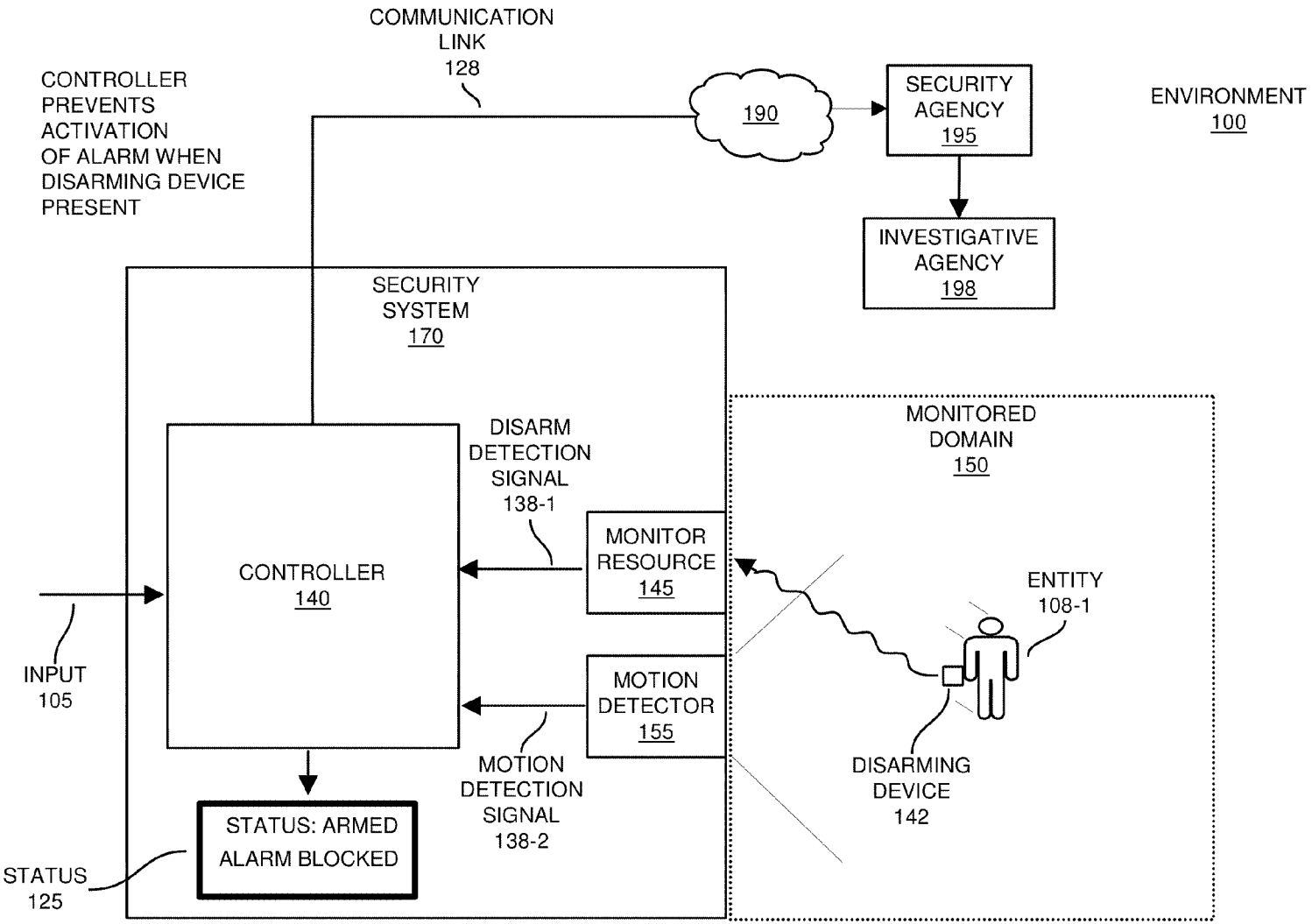
FIG. 1 is an example diagram illustrating a security system preventing activation of an alarm in response to detecting a disarming device in a monitored region according to embodiments herein.

The foregoing and other objects, features, and advantages of the invention will be apparent from the following more particular description of preferred embodiments herein, as illustrated in the accompanying drawings in which like reference characters refer to the same parts throughout the different views. The drawings are not necessarily to scale, with emphasis instead being placed upon illustrating the embodiments, principles, concepts, etc.

DETAILED DESCRIPTION AND FURTHER SUMMARY OF EMBODIMENTS

Now, more specifically, FIG. 1 is an example diagram illustrating a security system configured to conditionally prevent activation of a respective alarm notification according to embodiments herein.

As shown, environment 100 includes security system 170. Security system 170 can be installed in any suitable environment such as a home, business, etc.

In this example embodiment, security system 170 includes monitor resource 145 and motion detector 155. During operation, while security system 170 is armed, motion detector 155 monitors presence of motion associated with objects in monitored domain 150. Monitored domain 150 can be any suitable portion of environment 100 such as a room in a house, portion of building, outside area, etc.

Initially, controller 140 arms corresponding security system 170 in accordance with input 105. For example, input 105 can be control information received from a homeowner or other suitable resource to arm the security system 170.

In this example, via input 105, the corresponding security system 170 is initially configured to an ARMED state in which the controller 140 is configured to activate an alarm in response to detecting motion of one or more free-to-roam entities (such as entity 108-1) in monitored location 150.

Activation of an alarm as described herein can include any suitable actions such as audibly activating an alarm located in the monitored domain 150, transmitting a notification over communication link 128 and network 190 to a target entity such as security agency 195, initiating audible activation of a remote alarm, etc.

In one embodiment, the entities have unrestricted access to the monitored domain 150. That is, entity 108-1 (e.g., objects, items, etc.), and potentially other entities such as pets, intruders, etc., are able to freely enter and exit monitored domain 150 without having to break through physical barriers such as locked doors, locked windows, etc.

As shown, in addition to monitoring for motion, the monitor resource 145 of security system 170 monitors the domain 150 for presence of a disarming device 142. Monitor resource 140 can be configured to detect the presence of disarming device 142 in any suitable manner. For example, the disarming device 142 can be configured to transmit or reflect a wireless signal in monitored domain 150.

In one non-limiting example embodiment, the monitor resource 145 detects presence of the disarming device 142 based on the receipt of the wireless signal. For example, in accordance with one embodiment, disarming device 142 can be or include an RF (Radio Frequency) identifier tag, computer chip, etc., that transmits or reflects a wireless signal (e.g., an RF signal, optical signal, etc.) to monitor resource 145. In accordance with another embodiment, disarming device 142 can be a WiFi™ device capable of communicating with monitor resource 145 such as a respective wireless access point.

In response to detecting the presence of disarming device 142 in monitored domain 150, the monitor resource 140 generates disarm detection signal 138-1, which indicates whether disarming device 142 is present in monitored domain 150.

As its name suggests, the disarming device 142 disarms alarm notifications that would otherwise occur when motion is detected in monitored domain 150. That is, at times when monitor resource 145 detects presence of the disarming device 142 in the monitored domain 150, the controller 140 of the security system 170 prevents activation of a corresponding alarm even though the monitor resource 145 detects motion of the free-to-roam entity 108-1.

Assume in this example embodiment that motion detector 155 detects movement of free-to-roam entity 108-1 (such as a person, pet, etc.). Upon detecting motion of entity 108-1, motion detector 155 generates motion detection signal 138-2. Detection signal 138-2 indicates whether motion is detected in monitored domain 150.

Motion detector 155 can detect motion in any suitable manner. For example, motion detector 155 can be a passive infrared motion detector that senses body heat; motion detector 155 can be an ultrasonic sensor device that sends out pulses of ultrasonic waves and measures the reflection off a moving object; motion detector 155 can be a microwave device that sends out microwave pulses and measures changes to the pulses due to reflection off a moving object; motion detector 155 can be a tomographic motion detector device that senses disturbances to radio waves as they travel through an area surrounded by mesh network nodes and so on.

As previously discussed, the monitor resource 145 of security system 170 can be configured to continuously monitor the domain 150 for the presence of the disarming device 142. Even though motion associated with entity 108-1 may be detected as being present at the monitored location 150, the controller 140 prevents activation of a corresponding alarm notification at times in which the disarming device 142 is detected as being present at the monitored location 150.

In other words, in one embodiment, because security system 170 is ARMED as indicated by status 125, detection of motion by motion detector 155 (in the absence of detecting disarming device 142) would normally cause controller 140 to generate an alarm notification indicating a respective unwanted intrusion into domain 150. As mentioned, generation of an alarm notification can include communicating an alarm notification over communication link 128 and network 190 (such as the Internet, cable network, etc.) to security agency 195.

However, in this instance of detecting motion associated with entity 108-1, monitor resource 145 also detects presence of disarming device 142 and produces disarm detection signal 138-1 to indicate presence of disarming device 142 in monitored domain 150. Disarming device 142 can be possessed by (e.g., affixed to, held by, etc.) entity 108-1 to prevent activation of a respective alarm condition. For example, the entity 108-1 purposefully carries the disarming device 142 when entering and exiting the domain 150 to prevent occurrence of an alarm.

In this instance, even though motion is detected in domain 150 due to movement of entity 108-1, because monitor resource 145 detects presence of disarming device 142, the controller 140 of security system 170 prevents transmission of a respective alarm notification over communication link 128 to security agency 195. Accordingly, generation of the disarm detection signal 138-1 prevents activation of an alarm while security system 170 is ARMED. In other words, the disarm detection signal 138-1 sets the security system 170 into an ALARM BLOCKED mode.

Thus, embodiments herein can include receiving control input 105 (from a user such as a homeowner or other entity) to operate a security system 170 in a first mode in which the security system 170 conditionally activates an alarm (such as by sending an alarm notification) over network 192 to security agency 195 to indicate occurrence of motion (e.g., movement of entity 108-1) in a monitored domain 150. The first mode is akin to a conventional security system mode in which motion triggers activation of an alarm.

As mentioned, the security system 170 monitors the domain 150 for presence of disarming device 142. In response to detecting presence of the disarming device 142 in the monitored domain 150, the controller 140 of security system 170 switches to operating in a second mode (e.g., ARMED, ALARM BLOCKED) in which the controller 140 prevents activation of a respective alarm at times of detecting motion in the domain 150. Accordingly, presence of the disarming device 142 prevents activation of the respective alarm even though motion may be detected.

Subsequent to detecting presence of the disarming device 142, assume that the entity 108-1 and corresponding disarming device 142 exits the domain 150. In such an instance, in response to detecting absence of the disarming device 142 from the monitored domain 150, the controller 140 of the security system 170 switches back to operating the in the first mode (ARMED, ALARM NOT BLOCKED) again in which the controller 140 conditionally activates the respective alarm in response to detecting motion in the monitored domain 150.

Accordingly, presence of the disarming device 142 provides a way to at least temporarily prevent, block, disarm, etc., triggering of an alarm of a corresponding security system 170.

As discussed above, the disarming device 142 can be possessed by an entity such as a homeowner, pet, etc. The disarming device 142 can be a ring-shaped device carried by entity 108-1; the disarming device 142 can include a clip to secure the disarming device to a corresponding entity 108-1; the disarming device can be a collar worn by a pet; etc.

Via possession of disarming device 142, the entity 108-1 is free to roam about domain 150 without triggering a false alarm. More specifically, as mentioned, the controller 140 prevents notification of an intrusion to a security agency 195 managing occurrence of intrusions in the monitored domain 150 even though motion is detected in the monitored domain 150. Because security agency 195 does not receive the alarm notification of an intruder in domain 150, the security agency 150 does not notify the investigative agency 198 (such as local police) to needlessly investigate the matter. Accordingly, embodiments herein include preventing or reducing occurrence of false alarms.

Figure 2:
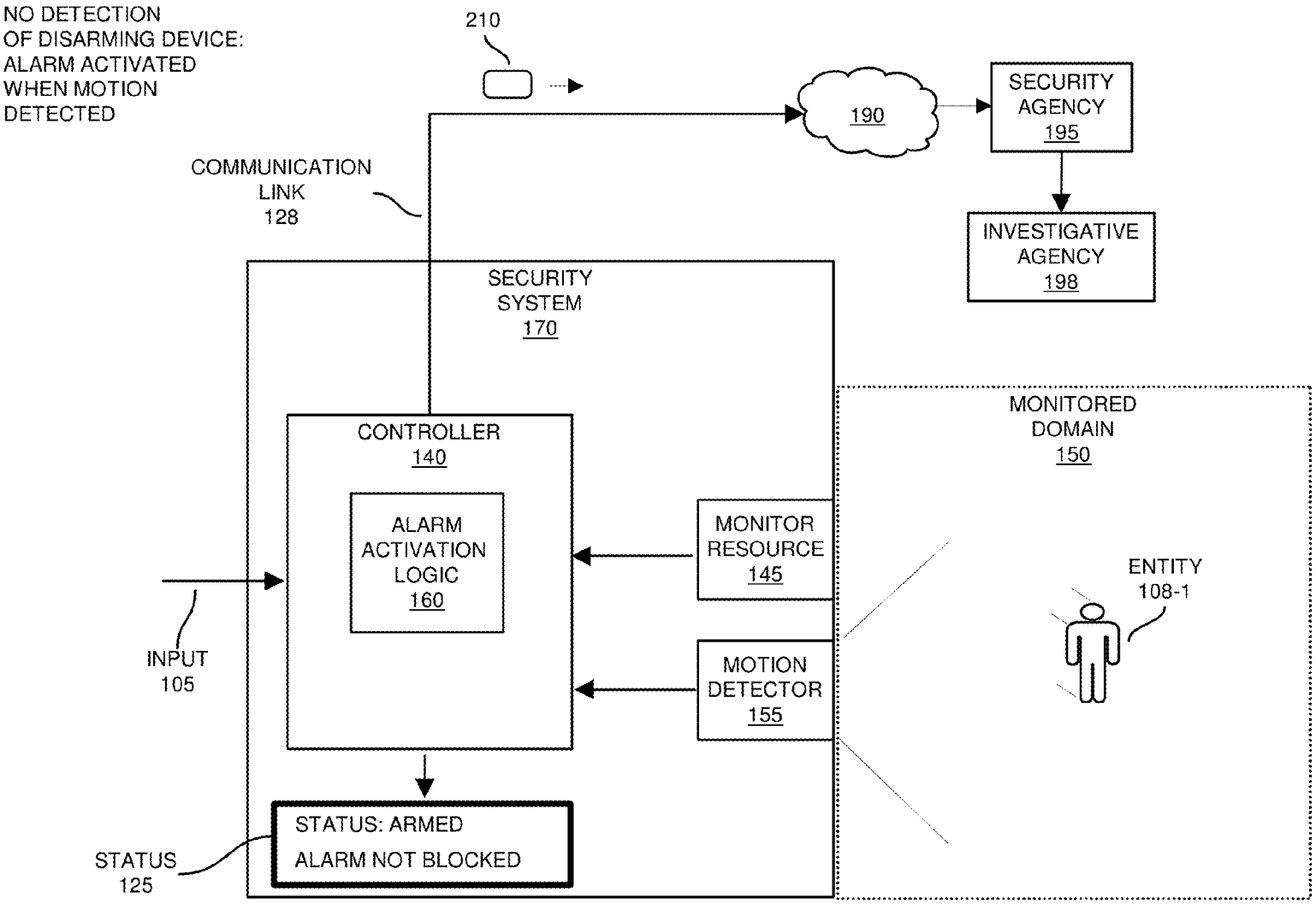
FIG. 2 is an example diagram illustrating a security system that activates a respective alarm in response to detecting motion in a monitored region according to embodiments herein.

FIG. 2 is an example diagram illustrating a security system that activates a respective alarm in response to detecting motion in the absence of a disarming device according to embodiments herein.

As shown, entity 108-1 moves through monitored domain 150. In this instance, the entity 108-1 does not possess disarming device 142. Motion detector 155 detects motion associated with entity 108-1. Because monitor resource 145 does not detect the presence of disarming device 142 and the motion detector 155 detects motion in the monitored domain 150, the controller 140 initiates activation of a respective alarm.

As previously discussed, activation of a respective alarm can include generating and transmitting alarm notification 210 such as a message over communication link 128, through network 190, to security agency 195.

Communication link 128 can be any suitable type of resource such as a phone line that carries voice communications, a wireless link, a data link conveying data packets, etc. Accordingly, the format associated with notification 210 can vary depending on the embodiment.

In this example embodiment, in response to receiving the alarm notification 210, the security agency 195 notifies investigative agency 198 of the intrusion. Accordingly, police can be dispatched to closely investigate the monitored domain 150 for possible illegal activity.

Figure 3:
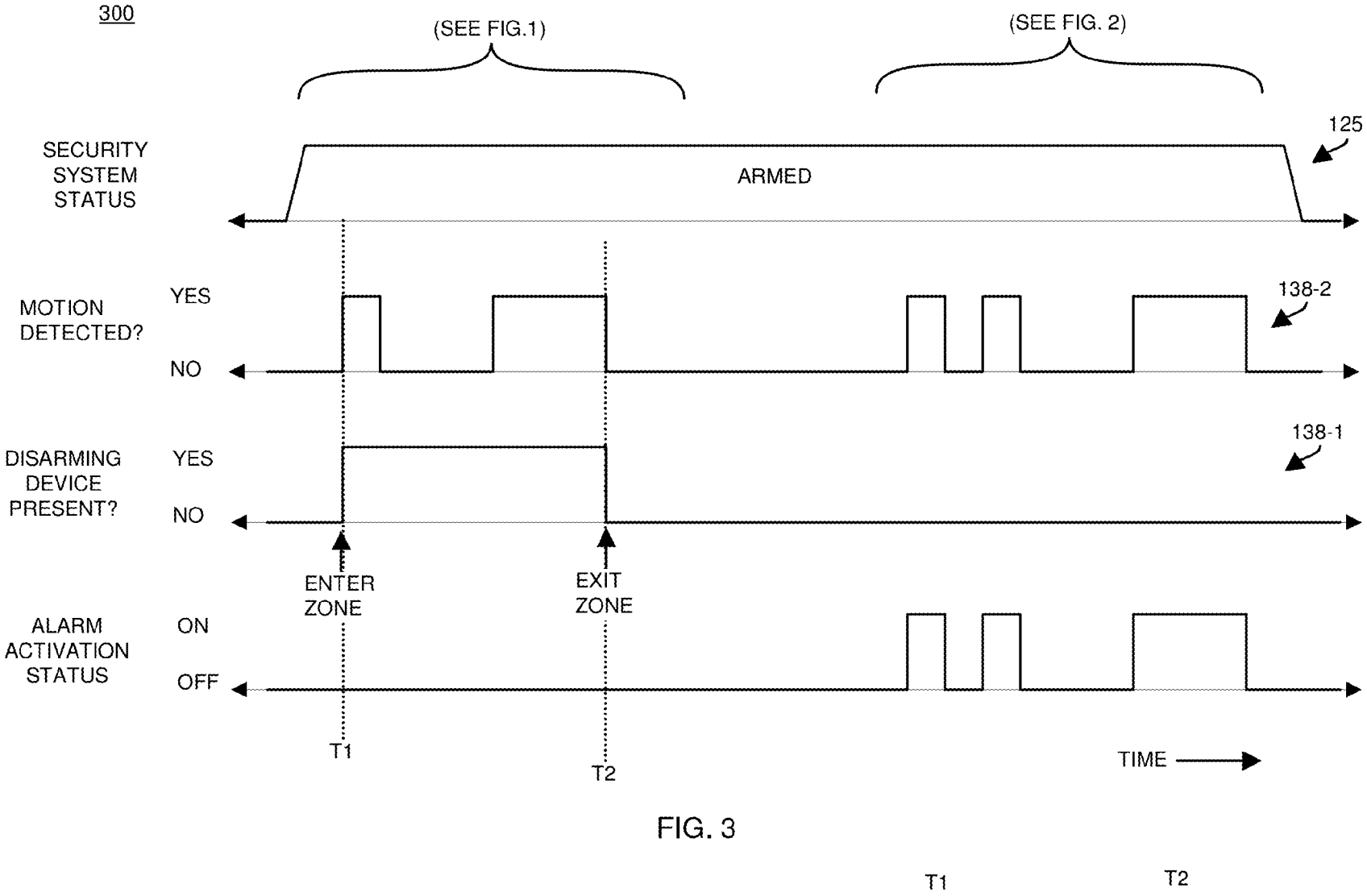
FIG. 3 is an example of a timing diagram illustrating conditional activation of an alarm according to embodiments herein.

FIG. 3 is an example timing diagram illustrating conditional activation of an alarm according to embodiments herein.

As shown in timing diagram 300, the monitor resource 145 generates disarm detection signal 138-1 indicating that disarming device 142 is present in monitored domain 150 between time T1 and time T2.

While disarming device 142 is present in monitored domain 150, the controller 140 disregards occurrence of motion detection by motion detector 155. That is, even though motion is detected domain 150 between time T1 time T2 as indicated by motion detection signal 138-2, the controller 140 prevents activation of a respective alarm notification during such time when disarming device 142 is present in monitored domain 150.

However, after time T2, the monitor resource 145 discontinues detecting presence of disarming device 142 in monitored domain 150. In this instance, as shown, the controller 140 initiates activation of a respective alarm when corresponding motion is detected. As previously discussed, the controller 140 provides notification of an intrusion to security agency 195.

If desired, the alarm activation status can be latched such that alarm activation status is set to a logic high after detecting motion in the absence of the disarming device 142.

Figure 4:
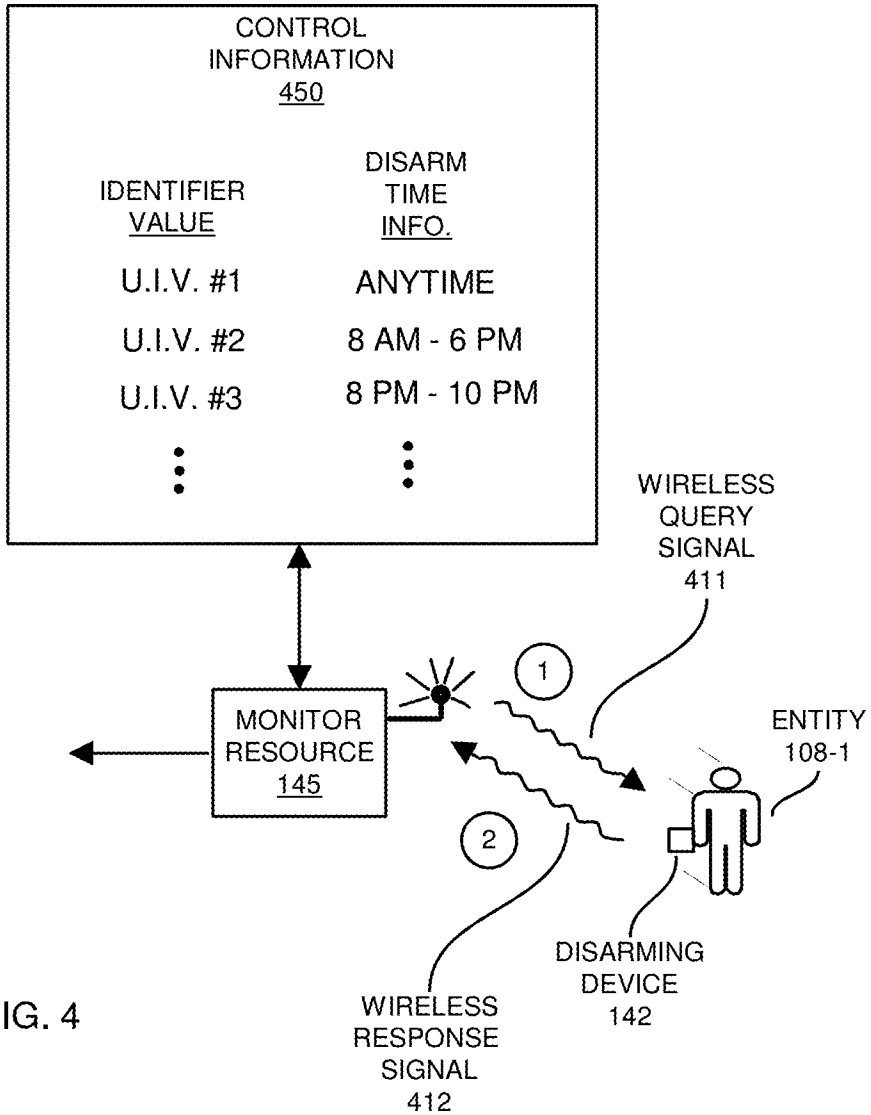
FIG. 4 is an example diagram illustrating detecting presence of a disarming device in a monitored region according to embodiments herein.

FIG. 4 is an example diagram illustrating detection of a disarming device according to embodiments herein.

Presence of the disarming device 142 can be detected in any suitable manner.

For example, the monitor resource 145 can receive a wireless disarm signal generated by the disarming device 142. The wireless disarm signal such as wireless response signal 412 can be received independent of a detected motion signal (as received by motion detector 155) indicating movement of an object in the monitored domain 150.

As previously discussed, the wireless disarm signal generated or reflected by disarming device 142 to monitor resource 145 indicates to prevent activation of a respective alarm of the security system 170 even though the movement of the entity 108-1 is detected in the monitored domain 150.

In one non-limiting example embodiment, to determine if the disarming device 142 is present in the monitored domain 150, the monitor resource 145 transmits a wireless query signal 411 in the monitored domain 150. In response to receiving the wireless query signal 411, the disarming device 142 generates wireless response signal 412 in monitored domain 150. The monitor resource 145 receives the wireless response signal 412 from the disarming device 142, indicating its presence to monitor resource 145.

In accordance with yet further embodiments, note that the disarming device 142 can be assigned a corresponding unique identifier value. In such an instance, the wireless response signal 412 transmitted from the disarming device 142 to the monitor resource 145 can include the corresponding unique identifier value assigned to the disarming device 142. Thus, the monitor resource 145 can receive the unique identifier value assigned to the disarming device 142.

Note that generation of the disarm detection signal 138-1 to prevent activation of a respective alarm can be conditional. For example, the monitor resource 145 can be configured to access control information 450. Control information 450 can include a set of unique identifier values of corresponding one or more disarming devices that have been authorized to disarm alarm of security system 170 when they are present in the monitored domain 150.

In this example embodiment, control information 450 indicates that a respective disarming device assigned unique identifier value #1 (such as a unique sequence of numbers and/or letters) can disarm activation of the alarm associated with security system 170 at any time. In this instance, assuming that disarming device 142 transmits the unique identifier value #1 in the wireless response signal 412, the monitor resource 145 generates disarm detection signal 138-1 to prevent activation of the alarm even though motion may be detected as being present in the monitored domain 150.

As further shown, the control information 450 can indicate different times such as time segments in which presence of corresponding disarming devices in monitored domain 150 are able to disarm activation of the alarm. For example, a disarming device assigned unique identifier value #2 (such as a unique sequence of numbers and/or letters) can be used between 8 AM and 6 PM to prevent activation of an alarm associated with security system 170; a disarming device assigned unique identifier value #3 can be used between 8 PM and 10 PM to prevent activation of an alarm associated with security system 170; and so on.

To make a decision whether to generate disarm detection signal 138-1 indicating to prevent activation of an alarm, the monitor resource 145 can be configured to receive time information such as from a real-time clock representing current time. In response to detecting that the control information 450 indicates that the corresponding disarming device assigned a respective unique identifier value is authorized to disarm the alarm because the current time (as indicated by the real-time clock) falls within a time range assigned to the detected disarming device, the controller 140 and prevents audible activation of a respective alarm.

Thus, assuming that the current time is 8 o'clock at night, an entity moving through monitored domain 150 and possessing a disarming device assigned unique identifier value #2 will cause the controller 142 to activate a respective alarm to indicate an intrusion because the disarming device assigned the unique identifier value #2 cannot temporarily prevent alarms outside of 8 AM to 6 PM.

Figure 5:
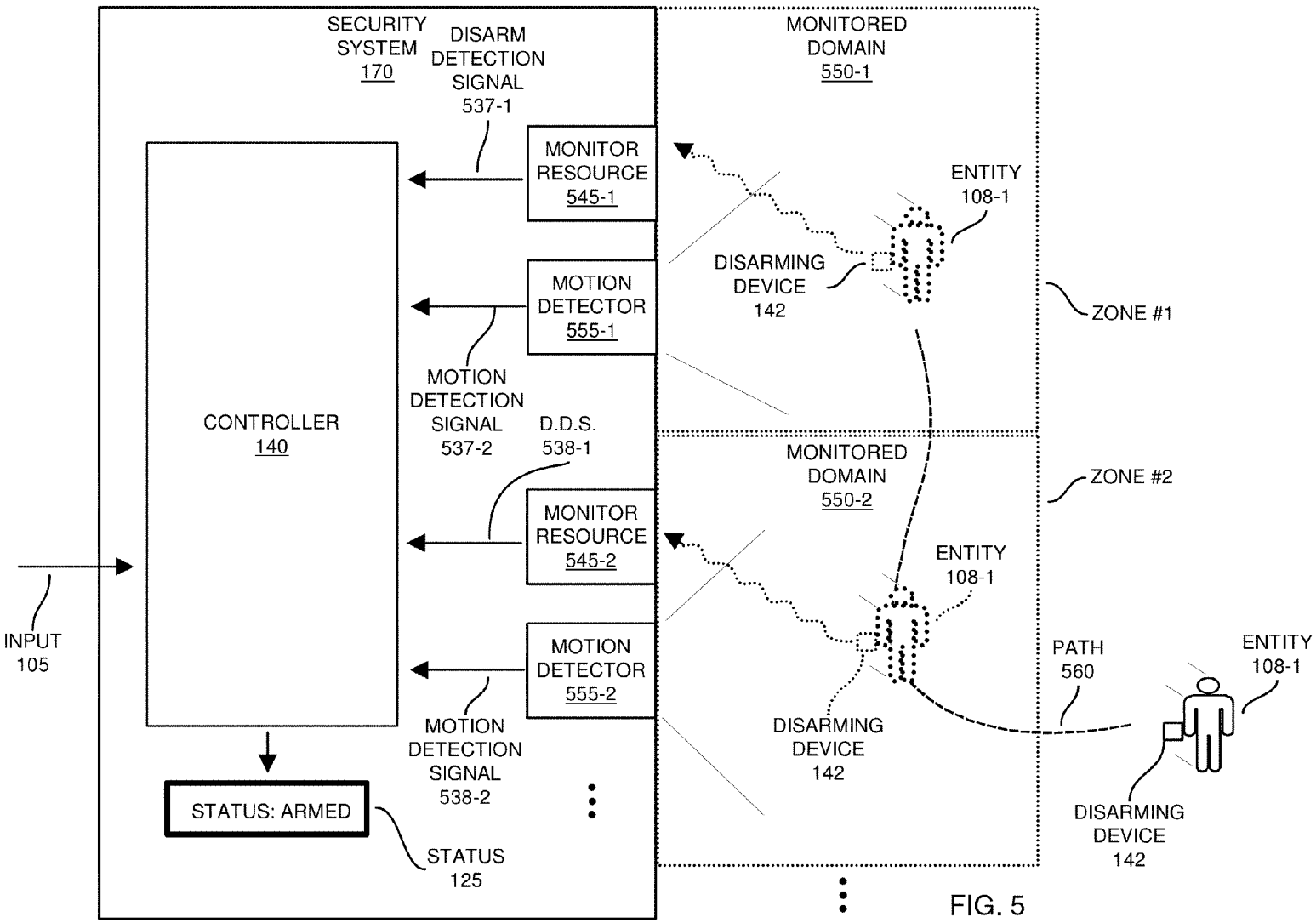
FIG. 5 is an example diagram illustrating use of a disarming device to prevent activation of an alarm according to embodiments herein.

FIG. 5 is an example diagram illustrating use of a disarming device to prevent activation of an alarm according to embodiments herein.

As shown, security system 170 can be configured to monitor activity associated with multiple zones including zone number one, zone number two, and so on.

In this example embodiment, the motion detector 555-1 monitors domain 550-1 for motion; the monitor resource 545-1 monitors for the presence of a disarming device in monitored domain 550-1; the motion detector 555-2 monitors domain 550-2 for motion; the monitor resource 545-2 monitors for the presence of a disarming device in monitored domain 550-2; and so on.

Motion detector 555-1 produces motion detection signal 537-2; motion detector 555-2 produces motion detection signal 538-2; and so on.

As the entity 108-1 passes through monitored domain 550-1, possession of the disarming device 142 prevents audible activation of a respective alarm at times when the disarming device 142 is detected as being present in the respective zone even though there is motion in the respective zone. For example, in a manner as previously discussed, monitor resource 545-1 produces disarm detection signal 537-1 indicating to prevent activation of the alarm while the entity 108-1 passes through zone number one.

Similarly, as the entity 108-1 passes through monitored domain 550-2, monitor resource 545-2 produces disarm detection signal 538-1 indicating to prevent activation of a respective alarm while the entity 108-1 passes through zone number two.

Accordingly the entity 108-1 can about multiple zones without triggering a respective alarm associated with security system 170.

Figure 6:
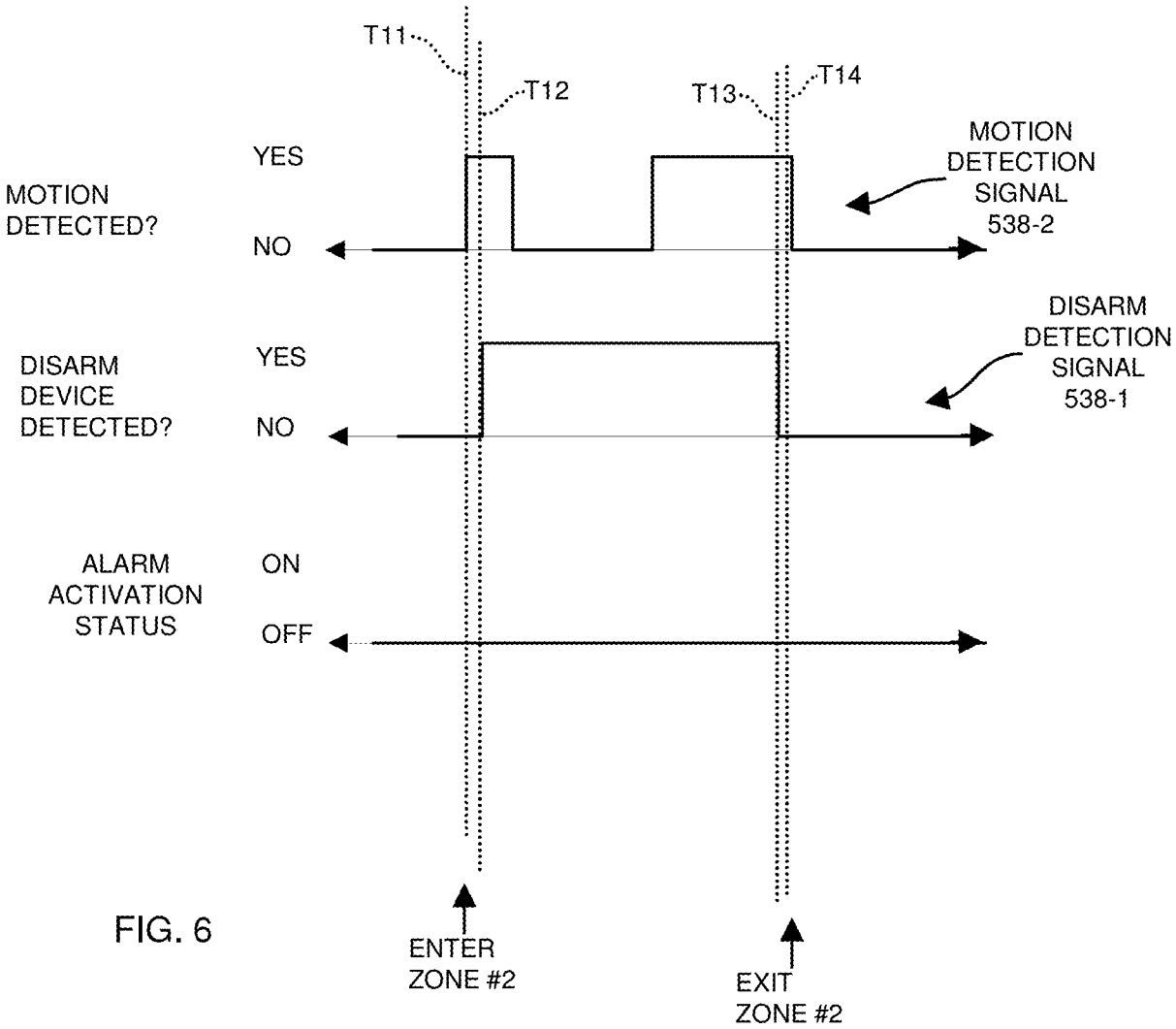
FIG. 6 is an example of a timing diagram including a motion detection signal and disarm detection signal according to embodiments herein.

FIG. 6 is an example timing diagram illustrating a motion detection signal and disarm detection signal according to embodiments herein.

In this example embodiment, assume that the corresponding security system 170 is armed. At time T11, assume that the motion detector 555-2 detects motion caused by movement of entity 108-1 through zone number two. In one embodiment, rather than immediately activating a respective alarm in response to detecting motion, subsequent to detecting movement of entity 108-1, the controller 140 delays audible activation of a respective alarm to determine whether the disarming device is present at the location.

For example, the monitor resource 545-2 detects presence of the disarming device 142 at time T12, which is after time T11. In this instance, because the monitor resource 545-2 detects presence of disarming device 142, the controller 140 does not activate the alarm in response to detecting motion associated with entity 108-1 at time T11. Thus, in one embodiment, because the events (such as motion detected at time T11 and presence of disarming device 142 at time T12) are detected close in time less than a threshold time value (such as one second), it is assumed that the detected motion was caused by entity 108-1, who possesses disarming device 142.

In accordance with further non-limiting example embodiments, in response to detecting the movement at time T11, the monitor resource 545-2 can be configured to transmit a wireless query 411 in monitored domain 550—to determine whether a respective disarming device is present in the monitored domain 550-2. In a manner as previously discussed, the disarming device 142 generates a corresponding wireless response signal 412. The monitor resource 545-2 receives the wireless response signal 412 from the disarming device 142 and prevents activation of a respective alarm.

Accordingly, one embodiment herein includes monitoring a domain for motion. Instead of immediately activating an alarm, subsequent to detecting presence of motion in the monitored domain, the controller 140 delays audible activation of the alarm to determine whether the disarming device is present in the monitored domain. If the disarming device responds indicating that it is present, the controller 140 prevents activation of a respective alarm.

Additionally, note that at time T13, the monitor resource 545-2 can detect that the disarming device 142 is no longer in the monitored domain 550-2. At time T14, later than time T13, the motion detector 555-2 discontinues detecting motion in monitored domain 550-2. In such an instance, because the delay between time T13 and time T14 is less than a predetermined threshold value such as one second (or any other suitable value), the controller 140 prevents activation of a respective alarm. Accordingly, even though motion is detected as being present in monitored domain 550-2 and disarming device 142 is detected as being absent from monitored domain 550-2, the controller 140 does not activate a respective alarm because it is assumed that the detected motion was caused by the entity 108-1, who was carrying the disarming device 142.

Thus, even though there may be delays in detecting that the disarming device 142 is present in a respective monitored domain, false alarms can be prevented. That is, the controller 140 performs a check to determine whether the disarming device 142 is present in a respective region as opposed to immediately activating a respective alarm.

Figure 7:
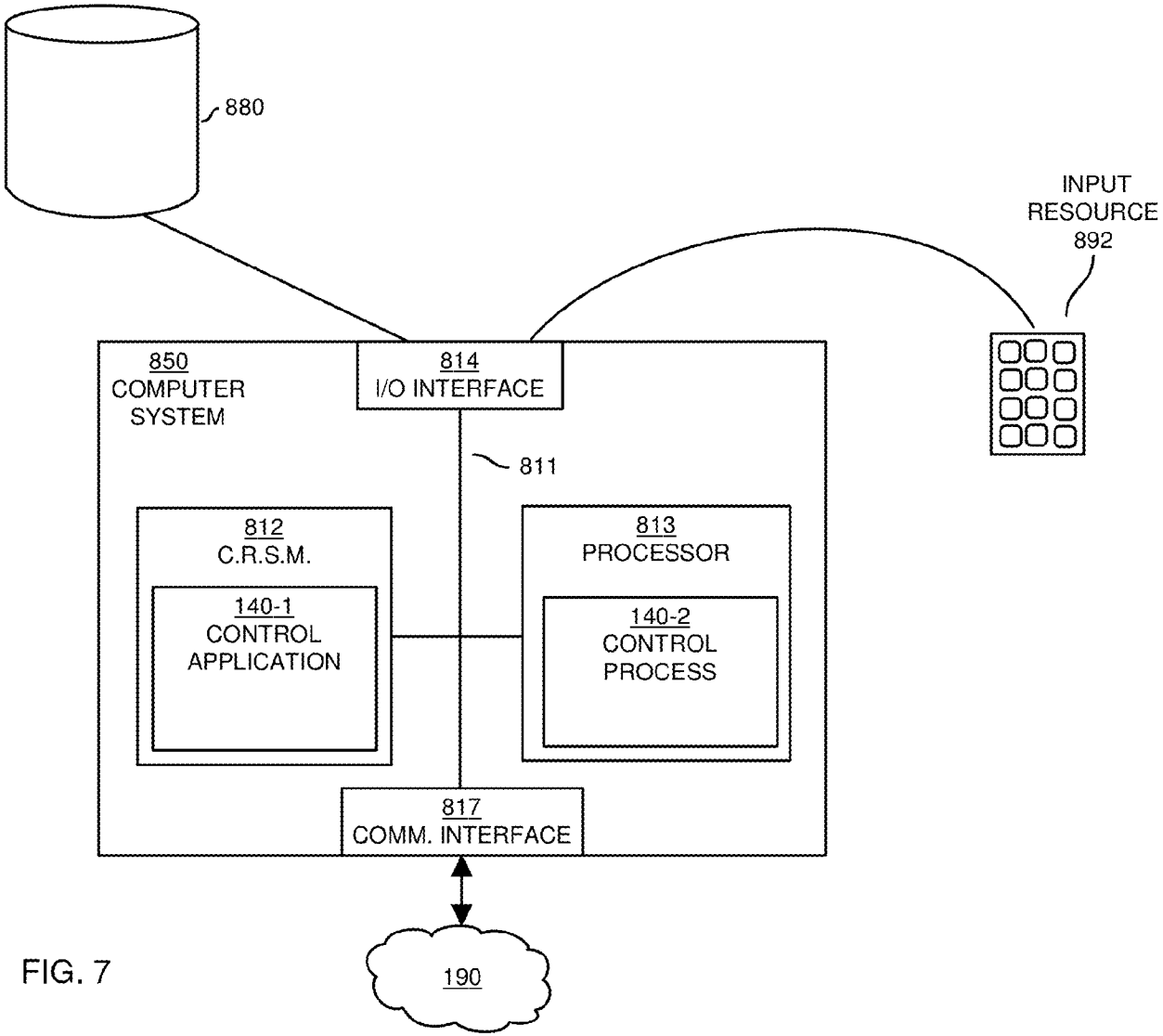
FIG. 7 is a diagram illustrating an example computer architecture in which to execute any of the functionality according to embodiments herein.

FIG. 7 is an example block diagram of a computer device for implementing any of the operations as discussed herein according to embodiments herein.

In one embodiment, security system 170 and/or controller 140 includes computer system 850 to carry out one or more operations as discussed herein.

As shown, computer system 850 of the present example includes an interconnect 811, a processor 813 (such as one or more processor devices, computer processor hardware, etc.), computer readable storage medium 812 (such as hardware storage to store data), I/O interface 814, and communications interface 817.

Interconnect 811 provides connectivity amongst processor 813, computer readable storage media 812, I/O interface 814, and communication interface 817.

I/O interface 814 provides connectivity to a repository 880 and, if present, other devices such as a playback device, display screen, input resource 892, a computer mouse, etc.

Computer readable storage medium 812 (such as a non-transitory hardware medium) can be any hardware storage resource or device such as memory, optical storage, hard drive, rotating disk, etc. In one embodiment, the computer readable storage medium 812 stores instructions executed by processor 813.

Communications interface 817 enables the computer system 850 and processor 813 to communicate over a resource such as network 190 to retrieve information from remote sources and communicate with other computers. I/O interface 814 enables processor 813 to retrieve stored information from repository 880.

As shown, computer readable storage media 812 is encoded with control application 140-1 (e.g., software, firmware, etc.) executed by processor 813. Control application 140-1 can be configured to include instructions to implement any of the operations as discussed herein.

During operation of one embodiment, processor 813 (e.g., computer processor hardware) accesses computer readable storage media 812 via the use of interconnect 811 in order to launch, run, execute, interpret or otherwise perform the instructions in control application 140-1 stored on computer readable storage medium 812.

Execution of the control application 140-1 produces processing functionality such as control process 140-2 in processor 813. In other words, the control process 140-2 associated with processor 813 represents one or more aspects of executing control application 140-1 within or upon the processor 813 in the computer system 850.

Those skilled in the art will understand that the computer system 850 can include other processes and/or software and hardware components, such as an operating system that controls allocation and use of hardware resources to execute control application 140-1.

In accordance with different embodiments, note that computer system may be any of various types of devices, including, but not limited to, a wireless access point, a mobile computer, a personal computer system, a wireless device, base station, phone device, desktop computer, laptop, notebook, netbook computer, mainframe computer system, handheld computer, workstation, network computer, application server, storage device, a consumer electronics device such as a camera, camcorder, set top box, mobile device, video game console, handheld video game device, a peripheral device such as a switch, modem, router, or in general any type of computing or electronic device. The computer system 850 may reside at any location or can be included in any suitable resource in network environment 100 to implement functionality as discussed herein.

Functionality supported by the different resources will now be discussed via flowcharts in FIGS. 8, 9, and 10. Note that the steps in the flowcharts below can be executed in any suitable order.

Figure 8:
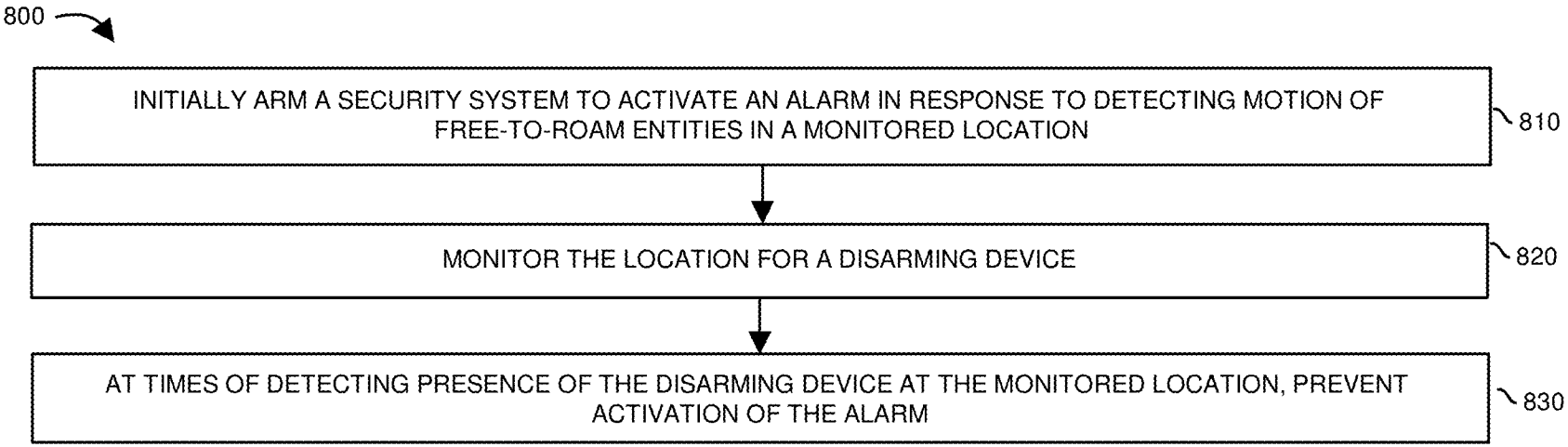
FIGS. 8, 9, and 10 are example diagrams illustrating methods according to embodiments herein.

FIG. 8 is a flowchart 800 illustrating an example method according to embodiments. Note that there will be some overlap with respect to concepts as discussed above.

In processing block 810, the controller 140 initially arms a security system 170 to activate an alarm in response to detecting motion of free-to-roam entities in a monitored location such as domain 150.

In processing block 820, the monitor resource 145 of security system 170 monitors the location for a disarming device 142.

In processing block 830, at times of detecting presence of the disarming device 142 at the monitored location, the controller 140 of security system 170 prevents activation of the alarm due to detected motion.

Figure 9:
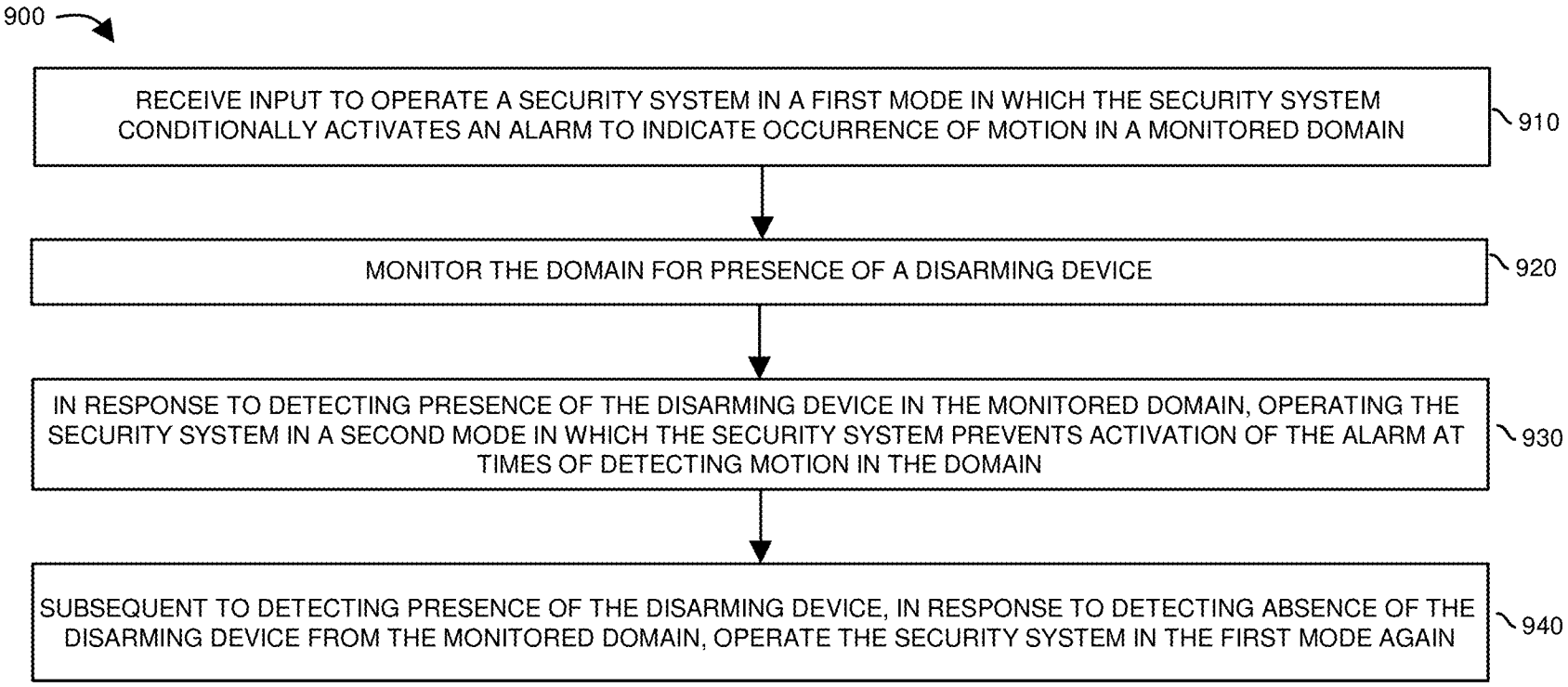

FIG. 9 is a flowchart 900 illustrating an example method according to embodiments. Note that there will be some overlap with respect to concepts as discussed above.

In processing block 910, the security system 170 receives input 105 to operate in a first mode in which the security system 170 conditionally activates a respective alarm to indicate occurrence of motion in a monitored domain 150.

In processing block 920, the security system 170 monitors the domain for presence of a disarming device 142.

In processing block 910, in response to detecting presence of the disarming device 142 in the monitored domain 150, the security system 170 operates in a second mode in which the security system 170 prevents activation of the alarm at times of detecting motion in the domain 150.

In processing block 910, subsequent to detecting presence of the disarming device 142 in monitored domain 150, and in response to detecting absence of the disarming device 142 from the monitored domain 150, the security system 170 operates in the first mode again.

Figure 10:
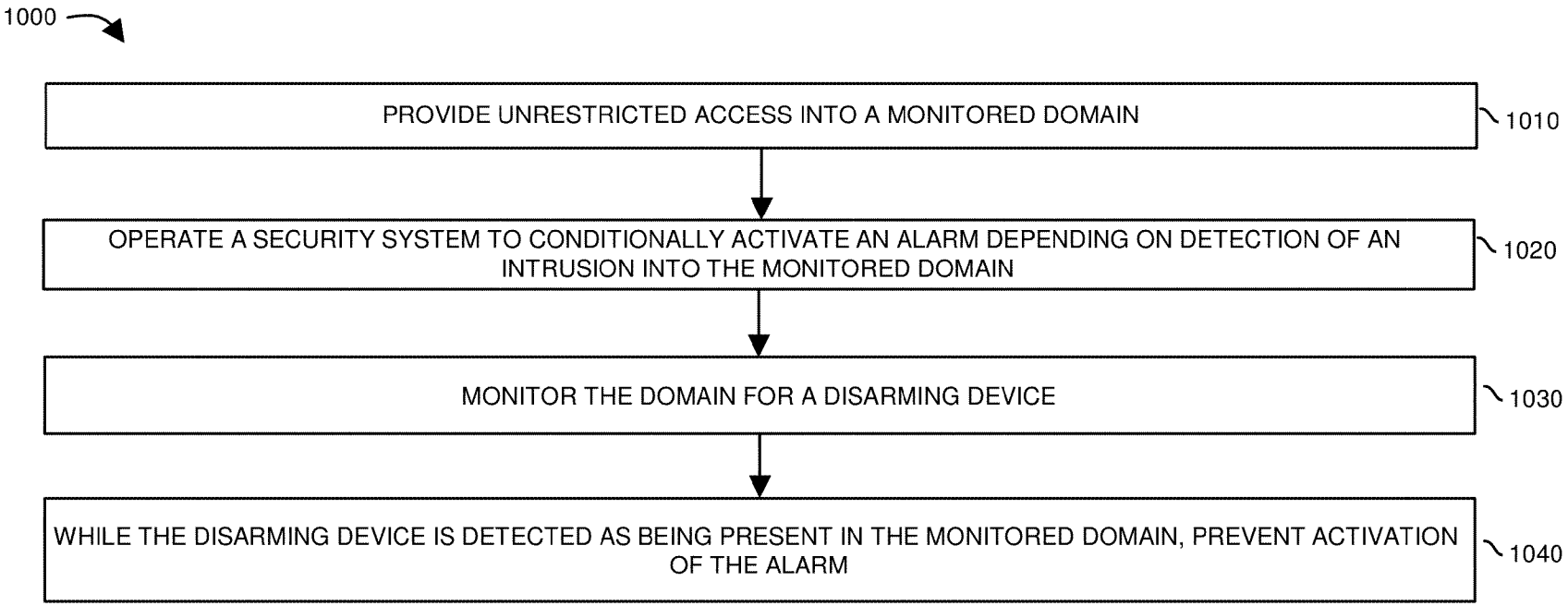

FIG. 10 is a flowchart 1000 illustrating an example method according to embodiments. Note that there will be some overlap with respect to concepts as discussed above.

In processing block 1010, entities (such as persons, pets, etc.) are provided unrestricted access into monitored domain 150. In other words, there may be no physical barriers (such as locked doors, windows, etc.) preventing the free-to-roam entities from entering or exiting domain 150.

In processing block 1020, the security system 170 conditionally activates an alarm depending on detection of an intrusion into the monitored domain 150.

In processing block 1030, the security system 170 monitors the domain 150 for a disarming device 142.

In processing block 1040, while the disarming device 170 is detected as being present in the monitored domain 150, the security system 170 prevents activation of the alarm.

Note again that techniques herein are well suited for use in security systems. However, it should be noted that embodiments herein are not limited to use in such applications and that the techniques discussed herein are well suited for other applications as well.

Based on the description set forth herein, numerous specific details have been set forth to provide a thorough understanding of claimed subject matter. However, it will be understood by those skilled in the art that claimed subject matter may be practiced without these specific details. In other instances, methods, apparatuses, systems, etc., that would be known by one of ordinary skill have not been described in detail so as not to obscure claimed subject matter. Some portions of the detailed description have been presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm as described herein, and generally, is considered to be a self-consistent sequence of operations or similar processing leading to a desired result. In this context, operations or processing involve physical manipulation of physical quantities. Typically, although not necessarily, such quantities may take the form of electrical or magnetic signals capable of being stored, transferred, combined, compared or otherwise manipulated. It has been convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, as apparent from the following discussion, it is appreciated that throughout this specification discussions utilizing terms such as "processing," "computing," "calculating," "determining" or the like refer to actions or processes of a computing platform, such as a computer or a similar electronic computing device, that manipulates or transforms data represented as physical electronic or magnetic quantities within memories, registers, or other information storage devices, transmission devices, or display devices of the computing platform.

While this invention has been particularly shown and described with references to preferred embodiments thereof, it will be understood by those skilled in the art that various changes in form and details may be made therein without departing from the spirit and scope of the present application as defined by the appended claims. Such variations are intended to be covered by the scope of this present application. As such, the foregoing description of embodiments of the present application is not intended to be limiting. Rather, any limitations to the invention are presented in the following claims.

We claim:

1. A method comprising:

initially arming a security system to activate an alarm in response to detecting motion of free-to-roam entities in a monitored location;

monitoring the location for a disarming device;

processing time information associated with the disarming device; and at times of detecting presence of the disarming device at the monitored location within a time range as specified by the time information, preventing activation of the alarm.

2. The method as in claim 1, wherein the free-to-roam entities have unrestricted access into the monitored location, the method further comprising:

continuously monitoring the location for the presence of the disarming device;

detecting motion of a free-to-roam entity at the monitored location; and even though the motion is detected as being present at the monitored location, preventing activation of the alarm at the times in which the disarming device is detected as being present at the monitored location.

3. The method as in claim 2 further comprising:

initiating activation of the alarm at other times when the disarming device is detected as being absent from the monitored location and there is motion detected at the location.

4. The method as in claim 1, wherein detecting presence of the disarming device includes:

receiving a wireless disarm signal generated by the disarming device, the wireless disarm signal received independent of a detected motion signal indicating movement of an object at the monitored location, the wireless disarm signal indicating to prevent activation of the alarm of the security system even though the movement of the object is detected as the monitored location.

5. The method as in claim 1 further comprising:

while the alarm of the corresponding security system is armed:

subsequent to detecting movement of an object at the location, delaying audible activation of the alarm to determine whether the disarming device is present at the location.

6. The method as in claim 1 further comprising:

subsequent to arming the alarm of the corresponding security system, detecting movement of an object at the location while the alarm is armed; and prior to audibly activating the alarm in response to detecting the movement, transmitting a wireless query in the location to determine whether the disarming device is present at the location.

7. The method as in claim 6, wherein detecting presence of the disarming device includes:

receiving a wireless response signal from the disarming device, the disarming device generating the wireless response signal in response to receiving the wireless query.

8. The method as in claim 1 further comprising:

in response to detecting the presence of the disarming device, preventing audible activation of the alarm even though motion is detected at the monitored location.

9. The method as in claim 1, wherein the corresponding security system monitors each respective zone of multiple zones at the location for motion, the method further comprising:

preventing audible activation of the alarm at times when the disarming device is detected as being present in the respective zone even though there is motion in the respective zone.

10. The method as in claim 1 further comprising:

at other times of detecting presence of the disarming device at the monitored location outside of the time range as specified by the time information, initiating activation of the alarm in response to detecting motion of a free-to-roam entity in the monitored location.

11. The method as in claim 10 further comprising:

receiving current time from a real-time clock; and preventing the activation of the alarm in response to detecting motion at the monitored location and that the current time falls within the time range as specified by the time information.

12. The method as in claim 1 further comprising:

receiving a unique code assigned to the disarming device; and utilizing the unique code to obtain the time information associated with the disarming device.

13. The method as in claim 12 further comprising:

receiving the unique code from the disarming device over a wireless signal transmitted by the disarming device.

14. The method as in claim 1 further comprising:

receiving current time from a real-time clock; and initiating activation of the alarm in response to detecting motion in the monitored location and that the current time falls outside the time range as specified by the time information.

15. A method comprising:

initially arming a security system to activate an alarm in response to detecting motion of free-to-roam entities in a monitored location;

monitoring the location for a disarming device; and at times of detecting presence of the disarming device at the monitored location, preventing activation of the alarm;

wherein detecting the presence of the disarming device at the location includes: receiving a unique identifier value transmitted from the disarming device, the unique identifier value assigned to the disarming device;

the method further comprising:

accessing control information, the control information including a set of unique identifier values of corresponding disarming devices that are authorized to disarm the alarm when present at the monitored location; and in response to detecting from the control information that the disarming device assigned the unique identifier value is authorized to disarm the alarm, preventing audible activation of the alarm even though motion is present at the monitored location;

wherein the control information specifies time segments in which presence of each of multiple different disarming devices at the location is able to disarm the alarm, the method further comprising:

receiving time information indicating when the disarming device was detected as being present at the monitored location; and in response to detecting that the control information indicates that the disarming device assigned the unique identifier value is authorized to disarm the alarm, preventing audible activation of the alarm.

16. A method comprising:

receiving input to operate a security system in a first mode in which the security system conditionally activates an alarm to indicate occurrence of motion in a monitored domain;

monitoring the domain for presence of a disarming device;

in response to detecting presence of the disarming device in the monitored domain within a time range assigned to the disarming device, operating the security system in a second mode in which the security system prevents activation of the alarm at times of detecting motion in the domain; and subsequent to detecting presence of the disarming device, in response to detecting absence of the disarming device from the monitored domain, operating the security system in the first mode again.

17. The method as in claim 16 further comprising:

providing unrestricted access into the monitored domain.

18. The method as in claim 16, wherein operating the security system in the second mode includes:

preventing notification of an intrusion to a security agency managing occurrence of intrusions in the monitored domain even though motion is detected in the monitored domain.

19. The method as in claim 16 further comprising:

during absence of the disarming device from the monitored region, activating the alarm in response to detecting motion in the monitored domain.

20. The method as in claim 16 further comprising:

subsequent to detecting presence of motion in the monitored domain, delaying audible activation of the alarm to determine whether the disarming device is present in the monitored domain.

21. The method as in claim 20, wherein determining whether the disarming device is present in the monitored domain includes:

transmitting a wireless query in the monitored domain to determine whether the disarming device is present in the monitored domain; and receiving a wireless response signal from the disarming device, the disarming device generating the wireless response signal in response to receiving the wireless query.

22. The method as in claim 16 further comprising:

detecting presence of the disarming device in the monitored domain based on receipt of a wireless signal generated by the disarming device.

23. The method as in claim 16 further comprising:

receiving a unique identifier value from the disarming device, the unique identifier value assigned to the disarming device; and in response to detecting, based on analysis of control information, that the disarming device assigned the unique identifier value is authorized to disarm the alarm, operating the security system in the second mode preventing audible activation of the alarm.

24. The method as in claim 16 further comprising:

in response to detecting presence of the disarming device in the monitored domain during the time outside a time range assigned to the disarming device, operating the security system in the first mode in which the security system activates the alarm at times of detecting motion in the domain.

25. A computer system comprising:

computer processor hardware; and a hardware storage resource coupled to the computer processor hardware, the hardware storage resource storing instructions that, when executed by the computer processor hardware, causes the computer processor hardware to perform operations of:

initially arming a security system to activate an alarm in response to detecting motion of free-to-roam entities in a monitored location;

monitoring the location for a disarming device;

processing time information associated with the disarming device; and at times of detecting presence of the disarming device at the monitored location within a time range as specified by the time information, preventing activation of the alarm.

26. The computer system as in claim 25, wherein the free-to-roam entities have unrestricted access into the monitored location, the computer processor hardware further performing operations of:

continuously monitoring the location for the presence of the disarming device;

detecting motion of a free-to-roam entity at the monitored location; and even though the motion is detected as being present at the monitored location, within the time range, preventing activation of the alarm at the times in which the disarming device is detected as being present at the monitored location.

27. The computer system as in claim 26, wherein the computer processor hardware further performs operations of:

initiating activation of the alarm at other times when the disarming device is detected as being absent from the monitored location and there is motion detected at the location.

28. The computer system as in claim 25, wherein detecting presence of the disarming device includes:

receiving a wireless disarm signal generated by the disarming device, the wireless disarm signal received independent of a detected motion signal indicating movement of an object at the monitored location, the wireless disarm signal indicating to prevent activation of the alarm of the security system even though the movement of the object is detected as the monitored location.

29. The computer system as in claim 25, wherein the computer processor hardware further performs operations of:

while the alarm of the corresponding security system is armed:

subsequent to detecting movement of an object at the location, delaying audible activation of the alarm to determine whether the disarming device is present at the location.

30. The computer system as in claim 25, wherein the computer processor hardware further performs operations of:

subsequent to arming the alarm of the corresponding security system, detecting movement of an object at the location while the alarm is armed; and prior to audibly activating the alarm in response to detecting the movement, transmitting a wireless query in the location to determine whether the disarming device is present at the location.

31. The computer system as in claim 30, wherein detecting presence of the disarming device includes:

receiving a wireless response signal from the disarming device, the disarming device generating the wireless response signal in response to receiving the wireless query.

32. The computer system as in claim 25, wherein the computer processor hardware further performs operations of:

in response to detecting the presence of the disarming device, preventing audible activation of the alarm even though motion is detected at the monitored location.

33. The computer system as in claim 25, wherein the corresponding security system monitors each respective zone of multiple zones at the location for motion, the computer processor hardware further performing operations of:

preventing audible activation of the alarm at times when the disarming device is detected as being present in the respective zone even though there is motion in the respective zone.

34. Computer-readable hardware storage having instructions stored thereon, the instructions, when carried out by computer processor hardware, causes the computer processor hardware to perform operations of:

providing unrestricted access into a monitored domain;

operating a security system to conditionally activate an alarm depending on detection of an intrusion into the monitored domain;

monitoring the domain for a disarming device; and while the disarming device is detected as being present in the monitored domain in a time range assigned to the disarming device, preventing activation of the alarm.

* * * * *